United States Patent [19]

Watson et al.

[11] 4,007,784

[45] Feb. 15, 1977

[54] WELL PISTON AND PARAFFIN SCRAPER CONSTRUCTION

[76] Inventors: Willie L. Watson, Box 54, Fredericksburg, Ohio 44627; Lonnie R. Watson, 347 Nold Ave., Wooster, Ohio 44691

[22] Filed: Oct. 14, 1975

[21] Appl. No.: 621,698

[52] U.S. Cl. ..... 166/170; 166/177; 417/56

[51] Int. Cl.[2] ..... E21B 37/02

[58] Field of Search ..... 166/156, 170, 177; 15/104.05, 104.16; 417/56

[56] References Cited

UNITED STATES PATENTS

| | | | |
|---|---|---|---|
| 2,668,593 | 2/1954 | Hay | 166/170 |
| 2,695,673 | 11/1954 | Coyle | 166/170 |
| 3,395,759 | 8/1968 | Talley, Jr. | 166/170 |
| 3,608,633 | 9/1971 | Talley, Jr. | 166/170 |

FOREIGN PATENTS OR APPLICATIONS

| | | | |
|---|---|---|---|
| 643,144 | 6/1962 | Canada | 166/177 |

*Primary Examiner*—James A. Leppink

[57] ABSTRACT

A piston device for removing liquids from within a well fluid delivery tube to increase the gas flow therefrom, and for scraping paraffin from the tube walls. The piston has an elongated tubular body formed with a plurality of axially spaced wiper or scraping rings which extend radially outwardly from the body for removing the paraffin from the tube walls. A rotor member is mounted on the bottom of the tubular body and is spaced a predetermined distance below the bottom-most ring. A plurality of angled grooves or vanes are formed in the rotor member which causes rotation of the rotor as the piston moves upwardly through the tube. The revolving rotor member produces a turbulence in the space between the rotor and bottom ring which forms a sealing effect across the tube wall providing a greater gas pressure below the piston than above it. The pressure differential causes the piston to rise to the top of the tube bringing with it paraffin and liquid deposits. The piston preferably is formed of titanium to provide a lightweight construction requiring less pressure differential to lift the piston out of the well tube as the heretofore steel constructions.

12 Claims, 7 Drawing Figures

WELL PISTON AND PARAFFIN SCRAPER CONSTRUCTION

BACKGROUND OF THE INVENTION

1. Field of the Invention

The invention relates to well components and in particular to a combination well piston and paraffin scraper which moves vertically within a well delivery tube to assist in bringing undesirable liquids and paraffin deposits to the top of the tube. More particularly, the invention relates to a gas well piston and paraffin scraper construction having rotor means which revolves during ascent of the piston within the delivery tube, creating a turbulence which forms a seal with the tube wall to increase the lift pressure on the piston.

2. Description of the Prior Art

A problem which exists in many gas and oil wells is the accumulation of paraffin deposits on the inner walls of the fluid delivery tube which restricts the flow of the fluid from the well if not removed. These paraffin deposits are particularly troublesome in gas wells. Many wells employ a free floating piston type scraper or "rabbit" which moves vertically within the delivery tube to scrape the paraffin from the tube walls. The lifting force for these scrapers is supplied by the pressure of the well gas as the gas is removed from the well for delivery into a pipeline or collection tanks.

Another common problem especially in low volume gas wells, is the removal of oil, water and other liquids which accumulate at the bottom of the well. These liquids, if not removed, restrict the gas flow requiring subsequent "blow-out" of the well, in which the well is opened to the atmosphere for a sufficient time period for the liquid to flow to the surface resulting in loss of usable gas.

Numerous types and arrangements of pistons and paraffin scrapers for wells have been devised for removal of such paraffin deposits and liquids. Examples of such constructions are shown in U.S. Pat. Nos. 1,720,049; 2,182,931; 2,184,393; 2,893,493; 3,034,581; 3,171,487; 3,229,768; 3,329,211; 3,394,763 and 3,456,727. These constructions use various blade arrangements and configurations for scraping the paraffin from the tube walls in combination with springs, discharge ports, sealing rings and other components to increase their efficiency. Most of these constructions are primarily concerned with removal of the paraffin with some having a secondary effect of removing the undesirable liquid accumulations from the bottom of the well.

Problems, however, occur in the use of many of these types of piston scrapers. The piston will rise rapidly within the tube upon initial opening of the gas delivery line but when used in a low volume, low pressure well, will stop in the tube before reaching the top thereof. Such stopping occurs because the gas pressure below the piston reaches the gas pressure above, due largely to escape of the propelling gas between the scraper elements and tube walls.

No gas well piston and paraffin scraper construction, of which we are aware, eliminates or reduces such problems by mounting a rotor element on the bottom of the piston which is believed to produce a turbulence in the spaced area between the rotor element and an adjacent wiper ring to effectively form a seal with the tube wall, thereby increasing the effective lift on the piston.

SUMMARY OF THE INVENTION

Objectives of the invention include providing a well piston and paraffin scraper construction adapted for vertical movement along the delivery tube of a well to remove the accumulation of oil and other liquid deposits at the bottom of the well, as well as to scrape paraffin deposits from the delivery tube walls; providing such a construction which is formed of titanium to reduce the weight of the piston and scrape construction without affecting its structural strength than the heretofore used steel construction, thereby requiring less gas pressure for its ascent within the delivery tube; providing such a construction having a rotor mounted on the lower end of the piston and spaced a predetermined distance below a bottommost paraffin wiper ring or scraper blade, in which the rotor has angled grooves formed therein to form vanes which rotate the rotor as the piston ascends in the tube, which rotation creates a turbulence in the space between the bottom ring and rotor providing a sealing effect between the tube walls and piston to reduce escape of the propelling gas; providing such a construction which is of a simple and rugged configuration having a single movable part thereby reducing maintenance and repair problems, and in which the movable part can be replaced easily if damaged or worn; and providing such a construction which eliminates difficulties heretofore encountered with prior devices, achieves the stated objectives simply and effectively, and which solves problems and satisfies existing needs.

These objectives and advantages are obtained by the well piston and paraffin scraper construction, the general nature of which may be stated as including an elongated tubular body adapted for vertical movement within a well tube; a plurality of radially extending ring means formed on the tubular body, certain of said ring means having diameters complementary to the diameters of the well tube to assist in scraping paraffin from the tube walls during movement of the tubular body within the tube; rotor means mounted on the tubular body and spaced a predetermined distance below the lowermost ring means, the rotor means having a diameter complementary to the diameter of the well tube; the rotor means being formed with angled groove means and vanes whereby rotation of the rotor means creates turbulence in the space between the lowermost ring means and the rotor means forming a sealing effect with the well tube to increase the lifting force exerted by pressure of the well gas on the tubular body; and the tubular body and ring means being integral and formed of titanium.

BRIEF DESCRIPTION OF THE DRAWING

A preferred embodiment of the invention — illustrative of the best mode in which applicants have contemplated applying the principles — is set forth in the following description and shown in the drawing and is particularly and distinctly pointed out and set forth in the appended claims.

Similar numerals refer to similar parts throughout the drawing.

DESCRIPTION OF THE PREFERRED EMBODIMENT

Figure 1:
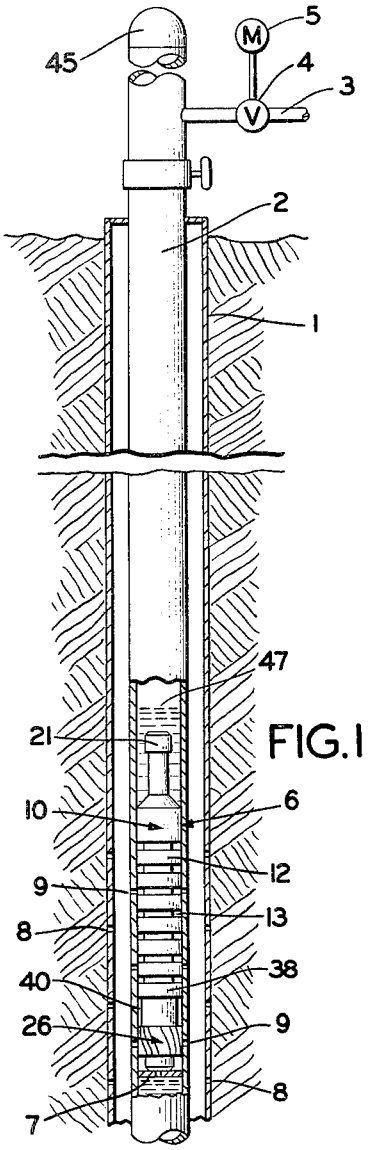
FIG. 1 is a longitudinal elevational view with portions broken away and in section, showing the improved piston and paraffin scraper construction located within a well tube.

A usual gas well arrangement is shown in FIG. 1 and includes an outer casing 1 extending into the ground having an inner fluid delivery tube 2 located therein and extending outwardly from the top of casing 1 above the ground. An outlet pipe 3 allows the flow of gas from tubing 2 to a suitable processing and storage tank where oil or other liquids are separated from the gas.

A valve 4 is mounted in outlet pipe 3 and is controlled by a timing motor 5 for selectively opening and closing valve 4 to control the flow of the gas and liquids from tube 2. The timing intervals of the opening and closing of valve 4 are dependent upon the volume and pressure of a particular well. For example, valve 4 may be opened for one hour and closed for two hours at some well sites to enable sufficient pressure to be built up within tubing 2 and casing 1, whereas wells at other sites will be on line for 1 hour and off for 1 hour.

The improved piston and paraffin scraper construction is indicated generally at 6 and is shown in the lower portion of tube 2 in an at rest position on a stop member 7. Casing 1 and tube 2 are formed with a plurality of perforations 8 and 9, respectively, adjacent the bottom of the well to permit the flow of gas, oil, water, etc. into the casing for delivery through tube 2.

Figure 2:
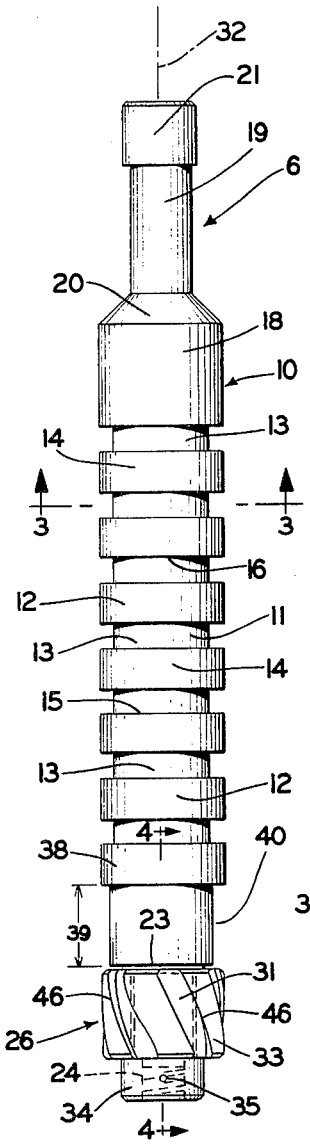
FIG. 2 is an enlarged elevational view of the piston and paraffin scraper construction of FIG. 1 removed from the well.
Figure 3:
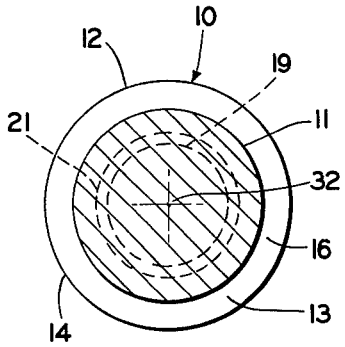
FIG. 3 is an enlarged sectional view taken on line 3—3, FIG. 2.

The improved piston and paraffin scraper construction 6 is shown particularly in FIG. 2 and includes an elongated tubular body indicated generally at 10, having a cylindrically shaped main body portion 11 throughout most of its axial length. A plurality of annular rings 12 are formed integral with cylindrical body portion 11 and extend radially outwardly therefrom, each of which have a diameter approximately equal to the internal diameter of tube 2. Rings 12 are spaced axially along cylindrical body 11 forming annular spaces 13 between adjacent pairs of rings 12. Each ring 12 has an annular, axially extending, smooth outer surface 14 terminating in top and bottom radial surfaces 15 and 16. Annular surfaces 14 may be sharp blade-like edges, or may be joined to radial surfaces 15 and 16 by beveled or angled edges if desired, without departing from the concept of the invention.

A longer axially extending topmost ring 18 is joined to a neck portion 19 by a conical surface 20. Neck 19 has a reduced diameter with respect to cylindrical body 11 and terminates in a knob 21 which provides a gripping projection for manually removing and placing piston 6 from within and into tube 2 when required. Topmost ring 18, neck 19, conical surface 20 and knob 21 also are all formed integral with body portion 11 as are rings 12.

Figure 4:
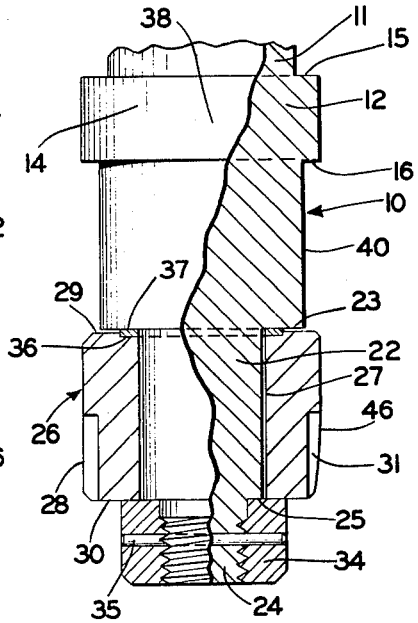
FIG. 4 is an enlarged fragmentary sectional view with portions broken away taken on line 4—4, FIG. 2.

The lower end of body 11 is formed with a reduced diameter shaft 22 integral with body 11, which forms a radially extending annular shoulder 23 with body 11 (FIG. 4). A threaded shank portion 24 extends from the lower end of shaft 22 and forms another annular shoulder 25 with shaft portion 22.

Elongated body 10 preferably is formed of titanium which is light in weight compared with the heretofore usual steel piston or rabbit constructions without sacrificing mechanical strength and favorable wear qualities. Likewise, body 10 and the components thereof preferably are integral with respect to each other and are machined from a cylindrical bar of titanium material having a diameter equal to the diameters of rings 12 and 18.

Figure 6:
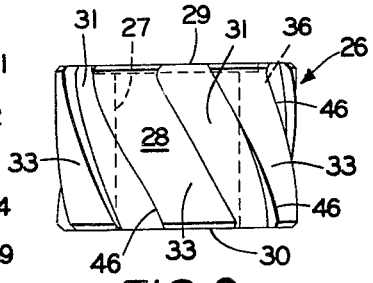
FIG. 6 is an elevational view of the rotor member of FIG. 5.
Figure 5:
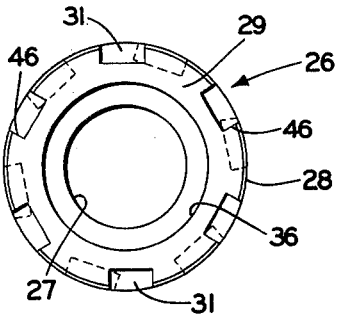
FIG. 5 is a top plan view of the rotor member of the improved piston and scraper construction removed from the tubular body.

In accordance with the invention, a rotor indicated generally at 26 (FIGS. 5 and 6) is rotatably mounted on shaft portion 22 at the lower end of tubular body 10. Rotor 26 has an annular configuration being formed with a smooth internal bore 27, an outer surface 28 and top and bottom radially extending end surfaces 29 and 30, respectively.

A plurality of angled or spiral shaped grooves 31 are formed in outer surface 28 of rotor 26 and extend in a generally spiral direction with respect to the longitudinal axis 32 of piston 6. Grooves 31 form a plurality of spiral shaped, vane-like members 33 on rotor 26, the purpose of which is discussed below.

Rotor 26 is journaled on shaft 22 of piston construction 6 and is retained thereon by a nut 34 threadably engaged with threaded end 24. A locking pin 35 may project through nut 34 and threaded shank 24 to prevent accidental loss of rotor 26 from shaft 22. An annular recess 36 is formed in top surface 29 or rotor 26 surrounding bore 27 in which a bearing ring 37 or other bearing means is received to provide a friction reducing member between shoulder 23 of body 11 and top surface 29 of rotor 26.

In further accordance with the invention, bottommost ring 38 of member 10 is spaced a predetermined axial distance 39 (FIGS. 2) from rotor 26, which forms a turbulence zone 40, the purpose of which is discussed below.

The improved "rabbit" or piston construction 6 is supported on stop member 7 adjacent the bottom of the well when valve 4 is in closed position. Gas, oil, and other liquids, indicated at 47, FIGS. 1 and 7, flow into tube 2 and casing 1 and collect above and below piston 6. When it is desired to flow gas from tube 2, valve 4 is opened by preset timer motor 5, whereupon the gas pressure which has built up at the bottom of the well during the off period, forces piston 6 upwardly along tube 2. The upward movement or ascent of piston 6 removes paraffin deposits 41 (FIG. 7) from the inner surfaces of the walls of tube 2, accumulating the same within annular spaces 13 between rings 12, as indicated at 42. The oil and other liquid deposits 47, likewise, are drawn upward by piston 6 during its ascent in tube 2.

Piston 6 will continue to ascend in tube 2 as long as the gas pressure below piston 6 is sufficiently greater than the gas pressure or line pressure above to supply the necessary lift on piston 6. In many wells, this gas pressure differential decreases sufficiently upon the piston reaching an upper level in tube 2 due to escape of the propelling gas around the piston body and rings thereof, so that piston 6 stops before ascending above output line 3, thereby not removing the oil, liquid and paraffin deposits from tube 2.

Figure 7:
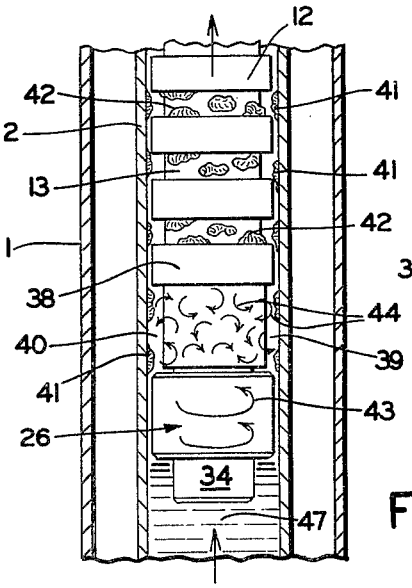
FIG. 7 is a fragmentary sectional diagrammatic view of the lower portion of the piston and scraper construction as it ascends in the well tube.

In accordance with the invention, the upward movement of piston 6 and the gas pressure differential is believed to cause rotation of rotor 26 as indicated by Arrows 43, FIG. 7, creating a turbulence (Arrows 44) in area or zone 39 between bottommost ring 38 and rotor 26. This turbulence is believed to create and provide a sealing effect between tubular body 10 and the walls of tube 2 reducing the escape of the propelling gas around body 10, thereby increasing the lift on piston 6 enabling it to rise completely from within tube 2 to a position above outlet 3. Piston 6 rises into the top or domed portion 45 of tube 2, enabling the oil, liquid, and paraffin deposits to flow out of tube 2 into line 3 and then into a separation tank (not shown) where the gas is separated from such deposits.

The particular action and effects which take place within the tube 2 due to the rotation of rotor 26 during the ascent of piston 6 is not known for certain. It is believed that such turbulence, as indicated at 44, is created in zone 39 which increases the lift on piston 6, does so by increasing the sealing effect between body 10 and the tube walls in the area surrounding this turbulence zone. Tests conducted on wells using improved piston construction 6 in contrast to a usual heretofore steel rabbit without a rotor thereon, enables the "time off" period of the well to be reduced. Such reduction is believed possible since reduced gas pressure is required to lift piston 6 from within tube 2 in order to remove the collected oil and other liquids from the bottom thereof, than the longer time period heretofore required in order to build up a greater gas pressure at the bottom of the well for removal of the piston and collected fluids. The formation of the components of piston 6 of titanium also is believed to contribute to the advantages obtained by the improved construction due to its reduced weight. Although in many situations it is believed that piston 6 may be formed of steel having rotor 26 mounted thereon without requiring the use of titanium in order to achieve the improved liquid removal and paraffin scraping characteristics thereof.

It has been found that the operating characteristics and advantages achieved by piston 6 are affected somewhat by spacing 39 or the length of turbulence zone 40. Providing spacing 39 with an axial length generally equal to the axial length of rotor 26 is believed to produce the most efficient operating results when using piston 6.

Piston and paraffin scraper construction 6 provides a simple, rugged construction having a single moveable component which enables oil, liquid, and paraffin deposits to be removed from a relatively low gas pressure well than heretofore possible with known piston and paraffin scraper constructions due to the incorporation of rotor 26 thereon.

Simplicity, convenience, and efficiency are enhanced further by the structural configuration and arrangements of rings 12, gripping neck 19, rotor 26, bearing 36, and locking nut 34 which are formed of rigid, solid, metallic material not susceptible to damage during use. Likewise, rotor 26 can be replaced easily should it become damaged during use. Rotor 26 has the additional advantage in that the edges 46 of vane-like members 33 are sharp and readily assist in removing any residual paraffin due to the rotational cutting and scraping action thereof, which may have been left by the sliding scraping action of rings 12.

Although piston and paraffin scraper construction 6 has been described and illustrated primarily for use in a gas well, such construction will perform satisfactorily in other types of wells such as oil wells.

Accordingly, the construction is simple, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the well piston and paraffin scraper construction is constructed and used, the characteristics of the construction, and the advantageous, new and useful results obtained; the new and useful structures, devices, elements, arrangements, parts, and combinations, are set forth in the appended claims.

We claim:

1. Piston construction adapted for vertical movement within a well tube, including a. an elongated tubular body having upper and lower ends with said lower end having a smooth shaft portion;

b. radially extending ring means formed on the tubular body, said ring means having a diameter complementary to the diameter of the well tube to assist in scraping paraffin from the tube during movement of the piston within the tube;

c. rotor means having an annular member formed with a smooth internal bore and a grooved outer surface, with the outer surface having a diameter complementary to the diameter of the well tube;

d. the rotor means internal bore being engageable with the smooth shaft portion of the tubular body to rotatably mount the rotor means on the lower end of said tubular body and spaced a predetermined distance below the ring means forming a turbulence zone in the space between the ring means and rotor means; and e. the grooved outer surface of the annular member forming vane means for rotating the rotor means upon upward movement of the piston construction in the well tube for forming a turbulence in the turbulence zone which provides a sealing effect with the well tube to assist gas pressure in the well in moving the piston construction upwardly in the well tube.

2. The construction defined in claim 1 in which the ring means is a plurality of annular rings formed integral with the tubular body and spaced axially along said tubular body.

3. The construction defined in claim 1 in which neck means is formed on the upper end of the tubular body; and in which a knob is formed on the upper end of said neck means.

4. The construction defined in claim 1 in which the vane means have a spiral-like configuration with respect to the axis of the tubular body.

5. The construction defined in claim 1 in which the elongated tubular body and ring means are integral and are formed of titanium.

6. Piston and paraffin scraper construction adapted for movement within a well tube, including a. an elongated tubular body having a lower end portion with a reduced diameter forming an annular shoulder with the remaining portion of said tubular body;

b. a plurality of axially spaced ring means formed integrally with the tubular body, certain of said ring means each having a diameter complementary to the diameter of the well tube to scrape paraffin from the tube during movement of the tubular body within the tube;

c. rotor means journalled on the reduced diameter lower end portion of the tubular body and spaced a predetermined distance below the lowermost ring means;

d. the rotor means having an annular ring with an outer surface and formed with a smooth internal bore;

e. angularly extending groove means formed in the outer surface of the rotor means providing vane means to rotate the rotor means upon ascent of the elongated tubular body in the well tube; and f. the rotor means and lowermost ring means forming a turbulence zone therebetween, whereby rotation of the rotor means creates turbulence in said zone forming a sealing effect with the well tube thereby increasing the lifting force exerted by pressure of the well gas on the tubular body.

7. The construction defined in claim 6 in which the rotor means annular ring has first and second end surfaces with an annular recess being formed in the first end surface; and in which bearing means is mounted within said annular recess between said first end surface and the annular shoulder of the tubular body.

8. Piston and paraffin scraper construction adapted for movement within a well tube, including a. an elongated tubular body;

b. a plurality of axially spaced ring means formed integrally with the tubular body, certain of said ring means, each having a diameter complementary to the diameter of the well tube to scrape paraffin from the tube during movement of the tubular body within the tube;

c. rotor means mounted on the tubular body and spaced a predetermined distance below the lowermost ring means;

d. the rotor means having an annular ring with an outer surface and formed with an internal bore, said rotor means being journalled on an end of the tubular body;

e. generally axially extending groove means formed in the outer surface of the annular ring providing vane means for the rotor means to rotate the rotor means upon ascent of the elongated tubular body in the well tube; and f. the rotor means and lowermost ring means forming a turbulence zone therebetween, whereby rotation of the rotor means creates turbulence in said zone forming a sealing effect with the well tube thereby increasing the lifting force exerted by pressure of the well gas on the tubular body.

9. The construction defined in claim 8 in which the tubular body and spaced ring means are formed of titanium.

10. The construction defined in claim 8 in which the axial length of the turbulence zone is generally equal to the axial length of the rotor means.

11. The construction defined in claim 8 in which a neck is formed on the upper end of the tubular body; and in which said neck has a reduced diameter in relationship to the diameter of said tubular body.

12. Piston construction adapted for vertical movement within a well tube, including a. a solid, metallic tubular-shaped body having upper and lower ends;

b. radially extending ring means formed integrally on the tubular body having a diameter complementary to the internal diameter of the well tube to provide a sealing effect with the well tube;

c. rotor means rotatably mounted on the lower end of the tubular body for rotation with respect to said body, with said rotor means being spaced a predetermined distance below the ring means and forming a turbulence zone in the space between the ring means and rotor means;

d. the rotor means including angularly extending vane means having an outer diameter complementary to the internal diameter of the well tube; and e. said rotor means and tubular body lower end being free of openings preventing the upward passage of gas and liquid except between the vane means, whereby the vane means imparts rotation to the rotor means upon upward movement of the piston within the tube forming a turbulence in the turbulence zone which provides an additional sealing effect with the well tube to assist gas pressure in the well in moving the piston construction upwardly in the well tube for removing liquids collected therein.

* * * * *